United States Patent [19]

Bailey

[11] 3,956,879

[45] May 18, 1976

[54] TIME INDICATING DEVICE

[76] Inventor: James R. Bailey, 4020 N. Pioneer Ave., Chicago, Ill. 60634

[22] Filed: Feb. 11, 1974

[21] Appl. No.: 441,325

[52] U.S. Cl. ..... 58/2; 58/6 A; 58/23 R; 58/125 R

[51] Int. Cl.[2] ..... G04B 45/00; G04B 19/24; G04C 3/00; G04B 19/02

[58] Field of Search ..... 58/1, 2, 4 R, 6 A, 42.5, 58/23 R, 125 R, 125 C, 126 E, 148–151

[56] References Cited

UNITED STATES PATENTS

| | | | |
|---|---|---|---|
| 989,290 | 4/1911 | Rhame et al | 58/151 |
| 1,776,001 | 9/1930 | Konigsberg | 58/126 E |
| 2,069,390 | 2/1937 | Prince | 58/6 A |
| 2,072,457 | 3/1937 | Larrabee | 58/125 C |
| 2,091,146 | 8/1937 | Hamilton | 58/126 C |
| 2,417,695 | 3/1947 | Lewis | 58/42.5 |

*Primary Examiner*—Edith Simmons Jackmon
*Attorney, Agent, or Firm*—Johnston, Keil, Thompson & Shurtleff

[57] ABSTRACT

The invention provides a time indicating device which contains an endless indicating belt carrying indicating means thereon that define three or more equally spaced segments of said belt, the belt passing beneath a face plate with an elongated opening therein mounted adjacent the belt so that from time to time said indicating means carried by said belt are visible through said opening, the length of said opening substantially corresponding to the length of one of said segments so that when said belt is moved past said opening there will be a moment when one of said segments will appear over the entire length of said opening. The device is especially useful in clocks where a plurality of belts are employed which are driven at different speeds to indicate seconds, minutes, hours or, if desired, additional belts can be used to indicate days, weeks, months or other time periods.

6 Claims, 25 Drawing Figures

HRS. MIN. SEC.

10
30
15
16
26
2
19
37
36
10
34
35
26
36
38
39
40
41
42
43
44
45
46
47
48
49
50
51
52
53
54
55

TIME INDICATING DEVICE

BACKGROUND

Various types of clocks have heretofore been proposed in which endless belts have been employed as a part of the mechanism. Thus, in U.S. Pat. No. 649,590, a time indicating device is disclosed containing three endless belts each bearing numerals which are exposed through openings in a face plate and which indicate time in hours and minutes. Currently, time indicating devices of this type are described as digital clocks. Other time controlled devices involving the use of belts carrying symbols or numbers are disclosed in U.S. Pat. Nos. 1,404,688, 2,952,967, 3,024,590, 3,712,050, and 3,747,321.

The digital indicating devices of the prior art are subject to the defect that it is sometimes difficult to read the letters, numerals, signs or the like. Moreover, some of the devices heretofore proposed for indicating time which involve the use of driven belt mechanisms are relatively complicated or require a relatively large space to enclose the mechanism.

OBJECTS

One of the objects of the present invention is to provide a time indicating device involving the use of one or more endless indicating belts which carry indicating means thereon that define three or more equally spaced segments and further characterized by the fact that a face plate with an elongated opening therein is mounted adjacent each said belt so that from time to time said indicating means carried by said belt are visible through said opening as said belt is moved past said opening, the length of said opening substantially corresponding to the length of one of said segments whereby when said belt is moved past said opening there will be a moment when one of said segments will appear over the entire length of said opening.

Another object of the invention is to provide a time indicating device of the type described in which one or more belts are each divided into three equally spaced segments by three equally spaced indicating means, preferably in the form of dots, so that when said belt or belts are moved past said opening or openings there will be a moment during such movement when two indicating means or dots are visible through said opening, one of said indicating means being visible at each of the opposite ends of said opening.

Another object of the invention is to provide a time indicating device of the type described in which said belt or belts contain four equally spaced segments, each segment being of the same length as the length of the opening in the face plate and with adjoining segments of contrasting color.

A further object of the invention is to provide novel clocks containing a plurality of endless indicating belts disposed adjacent elongated openings, said openings containing an indicia adjacent thereto calibrated in units of time, for example, seconds, minutes and hours, or, if desired, days, weeks and months, and means for driving said indicating belt operative to move one of the segments of each of said belts from one end to the other of the respective opening at predetermined controlled speeds.

Other objects and advantages of the invention will be apparent by reference to the following description in conjunction with the accompanying drawings.

THE DRAWINGS

Figure 23:
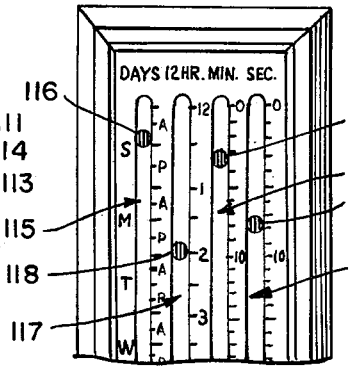
Figure 24:
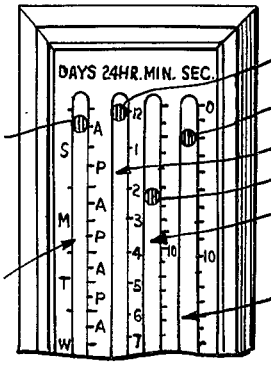

FIG. 23 illustrates another way of utilizing the invention in which four endless belts are employed, one to indicate days of the week, a second to indicate hours of the day over a twelve hour period, a third to indicate during each hour and a fourth to indicate seconds during each minute; and FIG. 24 illustrates another way of utilizing the invention in which four endless belts are employed, one to indicate days of the week, a second to indicate hours of the day over a 24 hour period, a third to indicate minutes during each hour and a fourth to indicate seconds during each minute.

BRIEF SUMMARY OF THE INVENTION

In brief, the invention involves a time indicating device comprising an endless indicating belt which carries indicating means thereon that define three or more equally spaced segments of said belt, means comprising a face plate with an elongated opening therein mounted adjacent said belt so that from time to time said indicating means carried by said belt are visible through said opening as said belt is moved past said opening, the length of said opening substantially corresponding to the length of one of said segments so that when said belt is moved past said opening there will be a moment when one of said segments will appear over the entire length of said opening, and means for moving said belt containing said indicating means past said opening. As illustrated by the drawings, the number of belts will depend upon the units of time it is desired to measure. The number of segments in each belt will depend upon the type of indicating means desired. Thus, where the indicating means employed is a dot or the like, the belt would normally contain three dots which would be equally spaced to define three segments. Where the indicating means consists of colored segments the belt would normally contain a minimum of four alternately colored segments of equal length and the length of each segment would correspond to the length of the opening in the face plate.

DETAILED DESCRIPTION OF THE INVENTION

In the embodiment of the invention illustrated in FIGS. 1 to 6 the time indicating device is a clock containing three endless belts 1, 2 and 3 mounted on a series of rollers and driven by a synchronous electric motor connected through a gear train to the rotary driving means containing sprockets, projecting members or teeth which engage perforations in the belts. The belts and driving means therefor are housed in a rectangular shaped housing generally indicated at 4 and comprising end members 5 and 6, side members 7 and 8, a bottom member 9 and a face plate 10. The various portions of the housing are secured together in any suitable manner, for example, by adhesively uniting the ends and sides and securing bottom member 9 to the sides and ends by means of screws 11 which can be removed in order to remove the bottom member. The ends and sides have offset portions 12 against which the face plate 10 is held by plate 26 or other suitable means.

Figures 1, 2, 3, 4:
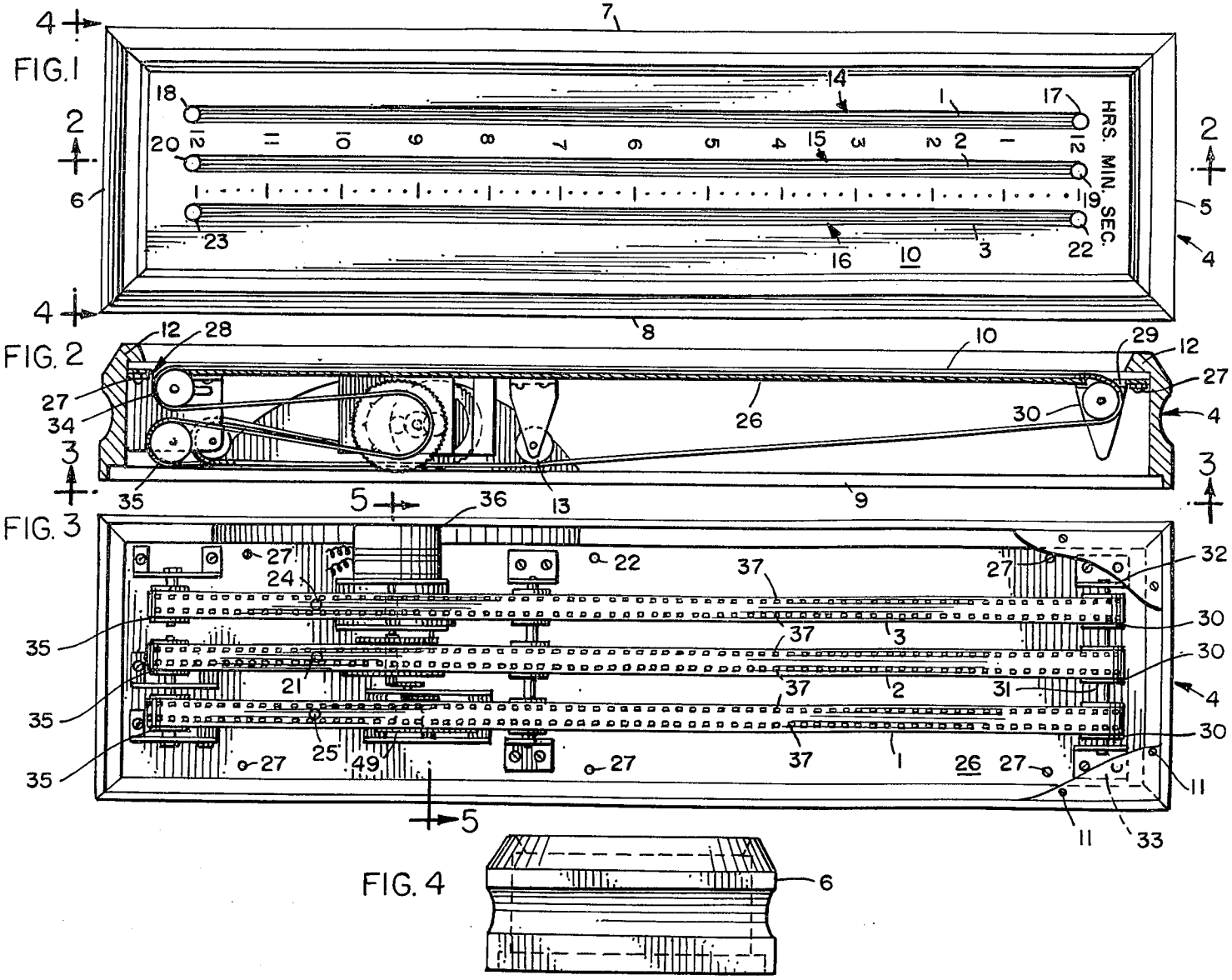
FIG. 1 is a front elevational view of a clock illustrating one embodiment of the invention.
FIG. 2 is a sectional view taken along the line 2,2 of FIG. 1.
FIG. 3 is a bottom view with parts broken away taken along the line 3,3 of FIG. 2.
FIG. 4 is an end view taken along the line 4,4 of FIG. 1.

As shown by FIG. 1 the face plate 10 contains three elongated openings 14, 15 and 16 which are directly opposite endless belts 1, 2 and 3, respectively. The top of the face plate also contains between opening 14 and opening 15 a series of numbers equally spaced to indicate hours as well as minutes. Between openings 15 and 16 the top of the face plate contains a series of four equally spaced markings between each number. The third elongated opening 16 is intended to indicate seconds.

Each of the endless belts 1, 2 and 3 contains an indicating means of the surface thereof in the form of three dots which are equally spaced to form three segments each segment having a length equal to the length of the respective openings 14, 15 and 16. These dots may be in the form of painted dots or they can be holes which may or may not be illuminated by a light, not shown, positioned within the housing. On belt 1 which is intended to indicate hours, dot 17 is positioned at the top of opening 14 opposite the numeral 12 and dot 18 is at the bottom of opening 14 opposite numeral 12. In this position the hour is either noon or midnight.

On endless belt 2 indicating dots 19 and 20 are also at the top and bottom, respectively, of the elongated opening 15. During the course of one hour when the dot 17 moves from the numeral 12 at the top of the scale to the numeral 1, the dot 19 will move the whole length of opening 15 until it occupies the position occupied by dot 20. At that time the dot 21 (see FIG. 3) which was behind the face plate will move to the position formerly occupied by the dot 19 opposite the numeral 12 at the top of the scale. Thus, when the dot 19 moves from 12 to 6, the time will be 30 minutes after the hour. At the same time, of course, the dot 17 will move from 12 to a position half way between 12 and 1.

On endless belt 3 the dots 22 and 23 appear at the top and bottom, respectively, of opening 16. When dot 22 moves to the position occupied by dot 23, a period of one minute will have elapsed. If it is desired to determine the number of seconds in a particular time period this can be done by following the movement of dot 22 opposite the numerals between openings 14 and 15 and opposite the scale markings between openings 15 and 16. Thus, when the dot 22 moves from its position at the top of the opening 16 to a position opposite numeral 6, thirty seconds will have elapsed. When the dot 22 arrives at the position previously occupied by the dot 23, 60 seconds will have elapsed and at this point dot 24 (see FIG. 3) will occupy the position at the top of the opening 16 formerly occupied by dot 22.

When the hour dot 17 arrives at the position occupied by dot 18, dot 25 will occupy the position formerly occupied by dot 17 in FIG. 1. A plate or sheet material 26 (FIG. 2) is secured to the housing by screws 27 or other suitable means and is provided with openings 28 and 29 through which the belts 1, 2 and 3 pass so that plate or sheet material 26 acts as a support for each of the belts. Plate or sheet material 26 can also be provided with a luminous surface so that the dots 17, 18, 19, 20, 21, 22, 23, 24 and 25 can be in the form of holes or transparent areas which will then have the appearance to the eye corresponding to the color of the upper surface of plate or sheet material 26. In order to create a highly visible luminous appearance luminous tapes may be adhesively secured to the upper surface of plate or sheet material 26 directly beneath the paths of endless belts 1, 2 and 3.

Each of the belts 1, 2 and 3 is supported at one end by idler rollers 30 independently mounted on shaft 31 which in turn is supported by brackets 32 and 33 secured by means of screws or other suitable means, either to plate 26 as shown in the drawings or to base plate 9. Centrally, each of the belts 1, 2 and 3 passes over idler rollers 13. At the opposite ends each of the belts 1, 2 and 3 passes over idler rollers 34 and 35 which are independently mounted on shafts that in turn are supported by brackets secured to the housing by screws or in any other suitable manner.

Figures 5, 6:
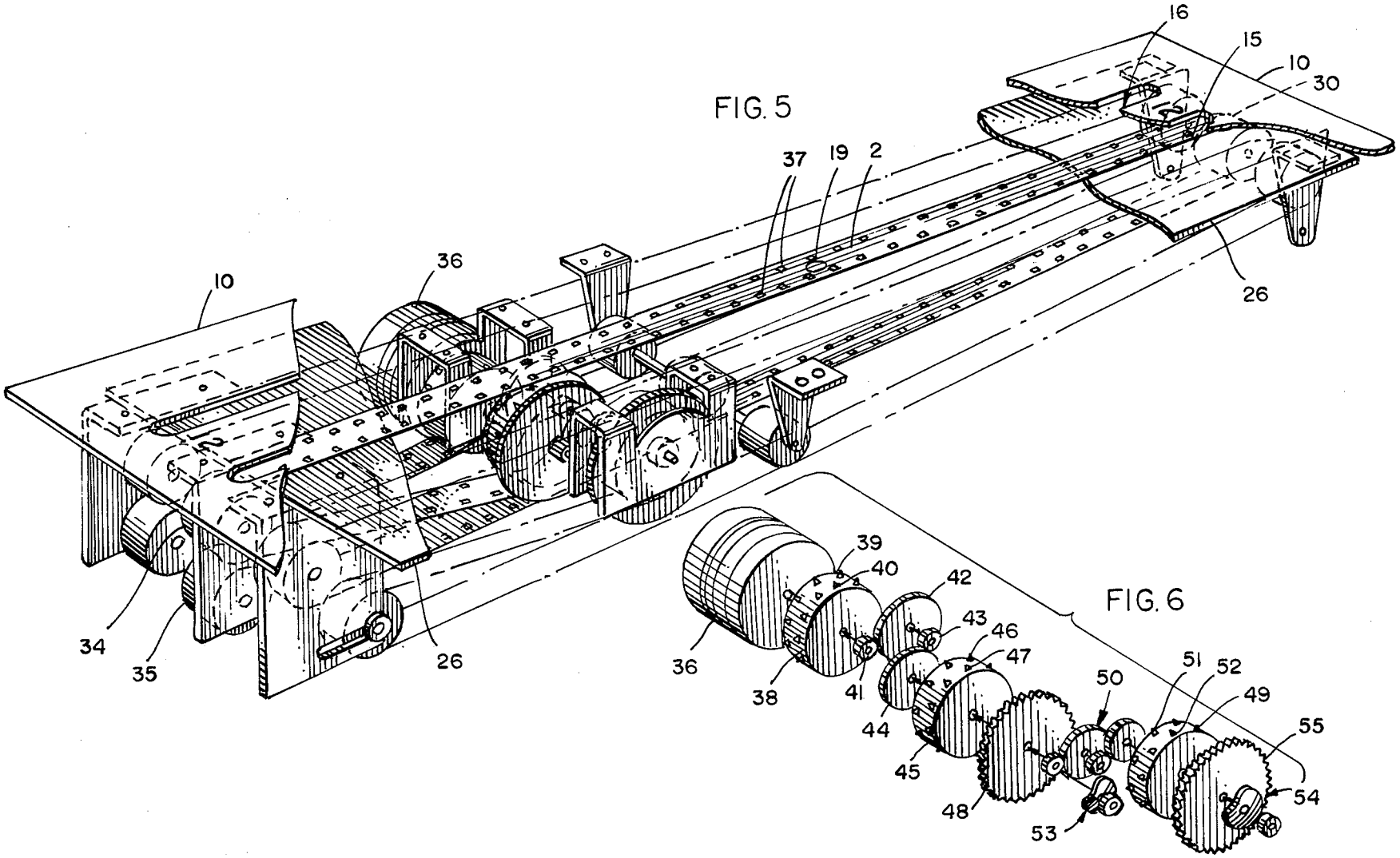
FIG. 5 is an enlarged perspective view, with parts broken away, of the clock illustrated in FIG. 1.
FIG. 6 is an exploded view of the elements of the driving mechanism shown in FIG. 5.

The belts 1, 2 and 3 are driven by a suitable motive means such as, for example, a synchronous electric clock motor 36 through a gear train containing sprockets with gear teeth adapted to engage perforations 37 in the belts. Thus, as shown in FIG. 6 the synchronous motor 36 drives a sprocket drum 38 containing rows of teeth 39 and 40 in parallel staggered alignment adapted to engage perforations 37 in endless belt 3. The driving shaft, not shown, engages pinion 41 which engages gear 42 which drives a shaft, not shown, on which is affixed a pinion 43 which drives gear 44 mounted on a shaft which drives sprocket drum 45 frictionally through a slip clutch. Sprocket drum 45 contains rows of teeth 46 and 47 in parallel alignment adapted to engage the perforations 37 in endless belt 2.

An adjustment wheel 48 which is integrally fixed to sprocket drum 45 provides a means to adjust the belt position for proper time indication. Sprocket drum 48 is driven through a gear reduction train generally indicated at 50. Sprocket drum 49 contains parallel rows of teeth 51 and 52 which may be in staggered alignment which alternately engage perforations 37 on belt 1. The driving of sprocket drum 49 is also effected through a slip clutch. The slip clutch for driving drum 45 is generally shown at 53 and the slip clutch for driving sprocket drum 49 is generally shown at 54. Sprocket drum 49 is integrally fixed to adjustment wheel 55. Sprocket drums 45 and 49 can be rotated on their respective shaft mountings by manually moving wheels 48 and 55 without rotating the shafts and hence it is possible to reset the belts 1 and 2 in any desired position without moving the gear train.

Figures 7, 7A:
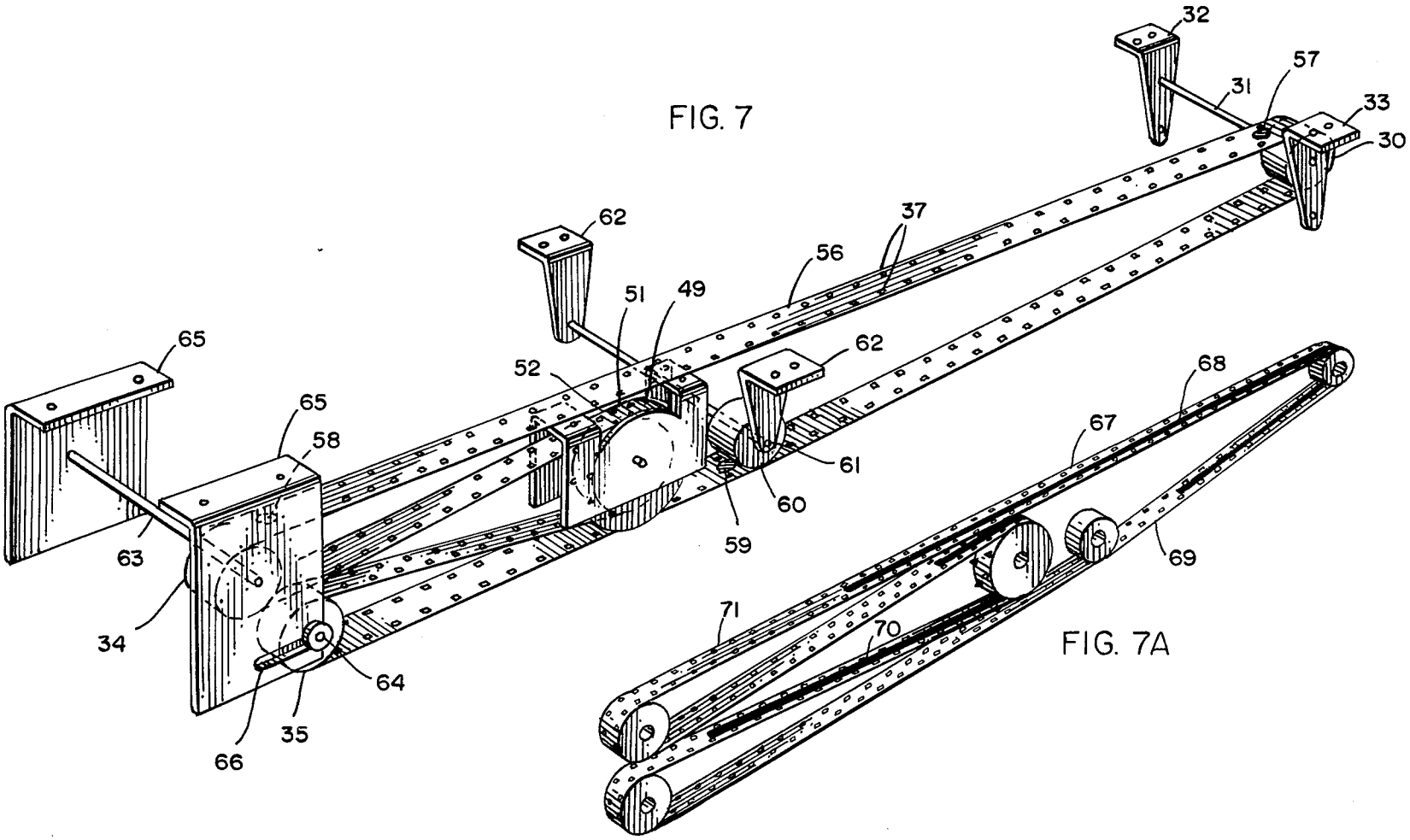
FIG. 7 is a perspective view, with parts broken away, of a single endless indicating belt carrying indicating means thereon in the form of dots which define 3 equally spaced segments of the belt.
FIG. 7A is a perspective view illustrating a modified form of the endless belt mechanism shown in FIG. 7 in which the belt contains four alternately colored segments.
Figure 8:
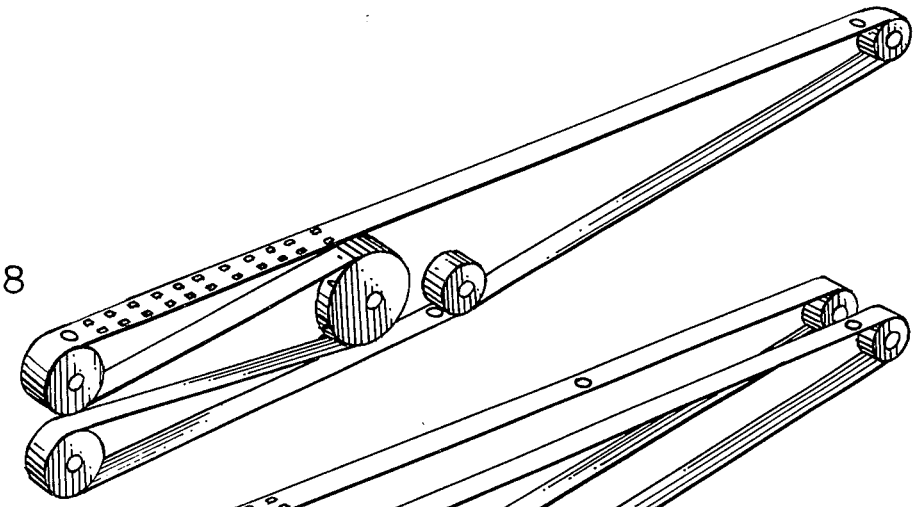
FIG. 8 is a perspective view of a simplified form of the single endless belt illustrated in FIG. 7.
Figure 9:
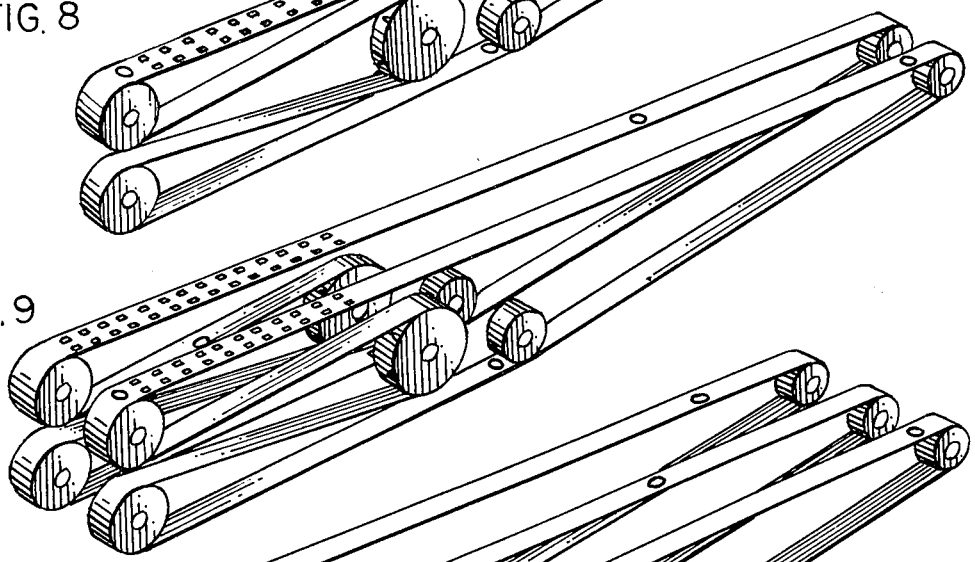
FIG. 9 is a perspective view of a simplified form of the time indicating device illustrating the use of two endless belts with indicating means thereon.
Figure 10:
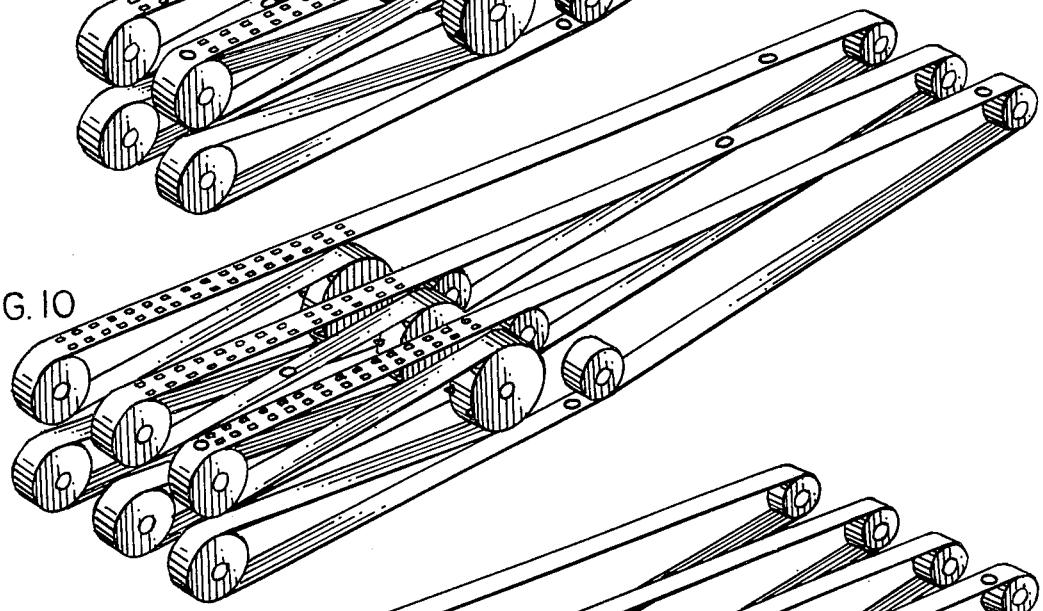
FIG. 10 is a perspective view of a simplified form of the time indicating device illustrating the use of three endless belts with indicating means thereon.
Figure 11:
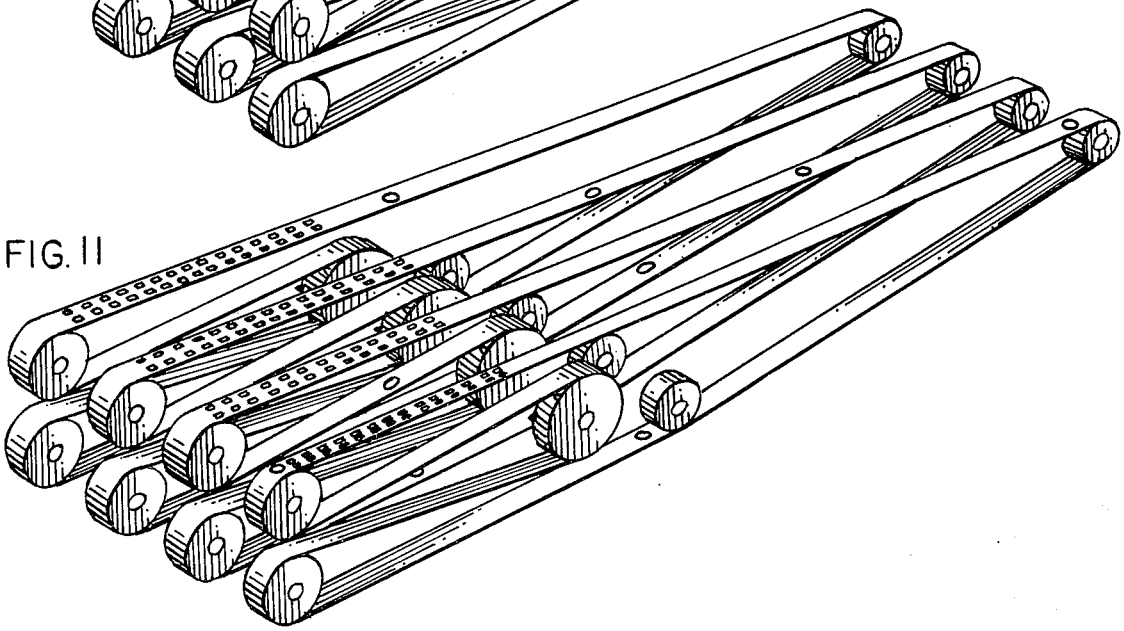
FIG. 11 is a perspective view of a simplified form of the time indicating device illustrating the use of four endless belts with indicating means thereon.

Referring to FIG. 7 which is a perspective view of the endless belt mechanism without the housing 4, the face plate 10 or the supporting palte 26, it will be observed that the endless belt 56 contains three indicating dots 57, 58 and 59 which define three segments of equal length. At one end the belt passes around a guide roller 30 and at the opposite end it passes around two guide rollers 34 and 35 and over driving sprocket drum 49 which contains parallel rows of teeth 51 and 52 adapted to engaged openings or perforations 37 in the endless belt. Idler roller 60 mounted on shaft 61 supported by brackets 62 contacts and preserves the alignment of belt 56. In the particular arrangement shown the idler rollers 34 and 35 are supported by shafts 63 and 64 which are mounted in openings in brackets 65. The brackets 65 are fastened to supporting plate 26 (shown in FIG. 5) by screws or in any other suitable means. The slot 66 is provided for shaft 64 in order to permit such shaft to be moved for the purpose of controlling tension on belt 56.

It should be understood that the brackets 32, 33, 62,62 and 65,65 rather than being fastened or secured to supporting plate 26 can be secured to the bottom supporting plate 9.

In FIG. 7A which illustrates another embodiment of the invention, the endless belt 67 is divided into four alternately colored segments 68, 69, 70 and 71. These segments can be black and white or in other contrasting colors. Each segment is of the same length as the elongated opening (for example, openings 14, 15 or 16 of FIG. 1) in face plate 10. By using an endless belt of this type the effect simulates that obtained with a thermometer reading. The face plate can be divided into twelve or twenty-four hour time periods with each segment of the endless belt corresponding to a fixed time period.

FIGS. 8, 9, 10 and 11 illustrate, respectively, the use of one, two, three or four endless belts each containing three indicating dots which divide each endless belt into segments of equal length.

FIGS. 12 to 24 illustrate a number of different ways in which the invention can be employed using one, two, three or four endless belts with one, two, three or four elongated openings in the face plate and with different types of indicia on the face plate to indicate various time periods.

Figure 12:
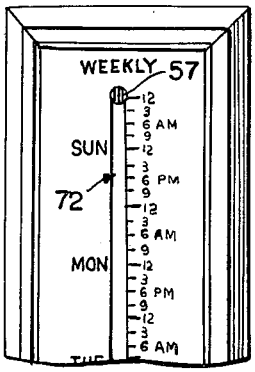
FIG. 12 illustrates one way of utilizing the invention wherein only a single endless belt is employed to indicate time in terms of hours of the day and days of the week.

In FIG. 12 only a single endless belt is employed containing three time indicating dots as described with respect to FIG. 7 and the face plate contains indicia for the days of the week and the time of day in hours as well as an indication of morning and afternoon periods. The movement of the endless belt is controlled so that the time indicating dot 57 will move from one end to the other of the elongated opening 72 over a period of seven days.

Figure 13:
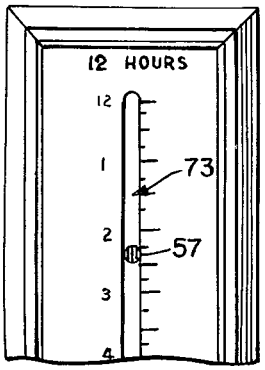
FIG. 13 illustrates another way of utilizing the invention in which a single endless belt is employed to indicate hours of the day over a 12 hour period.

In FIG. 13 a single endless belt containing indicating time dots is used to indicate hours of the day over a 12 hour period. The endless belt is driven in the manner previously described at a controlled speed so that the dot 57 moves from one end of the elongated opening 73 to the other in a period of 12 hours.

Figure 14:
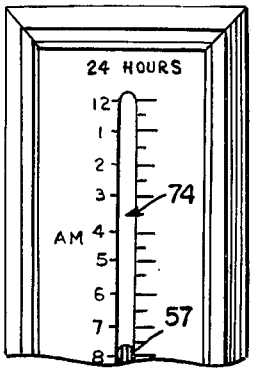
FIG. 14 illustrates another way of utilizing the invention in which only a single endless belt is employed to indicate hours of the day over a 24 hour period.

In FIG. 14 a single endless belt is employed to indicate hours of the day over a 24 hour period and the face plate is marked with indicia in the manner shown. The speed of the endless belt is timed so that the dot 57 moves from one end to the other of elongated opening 74 in 24 hours.

Figure 15:
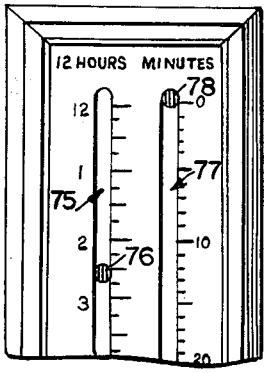
FIG. 15 illustrates another way of utilizing the invention in which two endless belts are employed, one to indicate hours of the day over a 12 hour period and the other to indicate minutes in each hour.

In FIG. 15 two endless belts are employed, one to indicate hours of the day over a twelve hour period and the other to indicate minutes in each hour. The endless belt adjacent elongated opening 75 is driven at a speed such that the indicating dot 76 moves from one end to the other of opening 75 in 12 hours and the endless belt adjacent elongated opening 77 is driven at a speed such that the indicating dot 78 moves from one end of the opening 77 to the other in 60 minutes.

Figure 16:
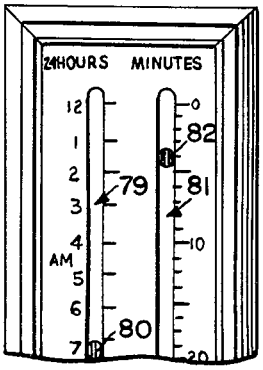
FIG. 16 illustrates another way of utilizing the invention in which two endless belts are employed, one to indicate hours of the day over a 24 hour period and the other to indicate minutes in each hour.

In FIG. 16 two endless belts are employed, one to indicate hours of the day over a 24 hour period and the other to indicate minutes of each hour. The endless belt adjacent opening 79 is driven at a speed such that time indicating dot 80 moves from one end to the other of the opening 79 in 24 hours. The endless belt adjacent elongated opening 81 is driven at a speed such that time indicating dot 82 moves from one end to the other of opening 81 in 60 minutes.

Figure 17:
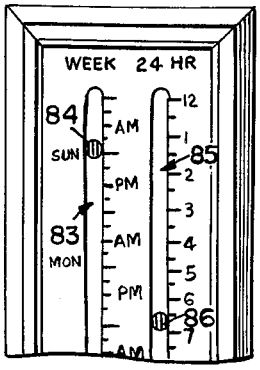
FIG. 17 illustrates another way of utilizing the invention in which two endless belts are employed, one to indicate days of the week and the other to indicate hours of the day during a 24 hour period.

In FIG. 17 two endless belts are employed, one to indicate days of the week and the other to indicate hours of the day during a 24 hour period. The endless belt adjacent elongated opening 83 is driven at a speed such that time dot 84 moves from one end to the other of the opening 83 is seven days. The endless belt adjacent elongated opening 85 is driven at a speed such that the time dot 86 moves from one end to the other of opening 85 in a period of 24 hours.

Figure 18:
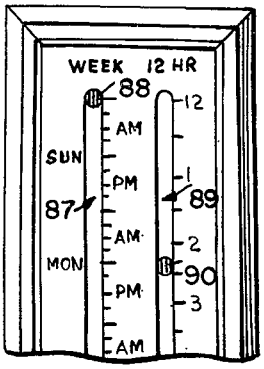
FIG. 18 illustrates another way of utilizing the invention in which two endless belts are employed, one to indicate days of the week and the other to indicate hours of the day over a 12 hour period.

In FIG. 18, two endless belts are employed, one to indicate days of the week and the other to indicate hours of the day over a 12 hour period. The endless belt adjacent elongated opening 87 is driven at a speed such that the indicating dot 88 moves from one end to the other of opening 87 in a period of one week. The endless belt opposite opening 89 is driven at a speed such that the indicating dot 90 moves from one end to the other of opening 89 in a period of 12 hours.

Figure 19:
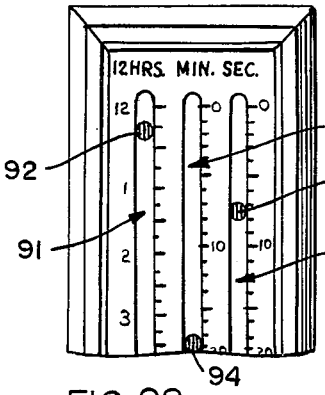
FIG. 19 illustrates another way of utilizing the invention in which three endless belts are employed, one to indicate hours over a twelve hour period, another to indicate minutes during each hour and the third to indicate seconds during each minute.

In FIG. 19 three endless belts are employed, one to indicate hours over a twelve hour period, another to indicate minutes during each hour and the third to indicate seconds during each minute. The belt adjacent opening 91 is driven at a speed such that indicating dot 92 moves from one end to the other of opening 91 in twelve hours. The belt adjacent opening 93 is driven at a speed such that the indicating dot 94 moves from one end to the other of opening 93 in sixty minutes. The belt adjacent opening 95 is driven at a speed such that the indicating dot 96 moves from one end to the other of opening 95 in 60 seconds.

Figure 20:
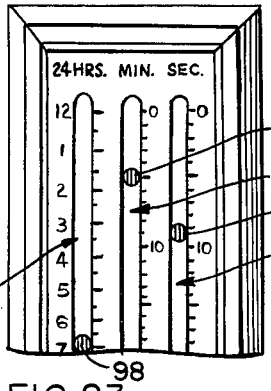
FIG. 20 illustrates another way of utilizing the invention in which three endless belts are employed, one to indicate hours over a 24 hour period, another to indicate minutes during each hour and the third to indicate seconds during each minute.

In FIG. 20 three endless belts are employed, one to indicate hours over a 24 hour period, another to indicate minutes during each hour and the third to indicate seconds during each minute. The operation is similar to that described with respect to FIG. 19 except that the endless belt adjacent opening 97 is driven at a speed such that indicating dot 98 moves from one end to the other of said opening in a period of 24 hours. The endless belt adjacent opening 99 is driven at a speed such that the indicating dot 100 moves from one end to the other of opening 99 in sixty minutes. The endless belt adjacent opening 101 is driven at a speed such that indicating dot 102 moves fromm one end to the other of opening 101 in 60 seconds.

Figure 21:
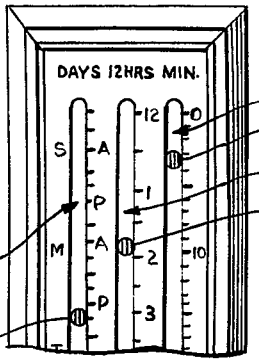
FIG. 21 illustrates another way of utilizing the invention in which three endless belts are employed, one to indicate days of the week, another to indicate hours of the day over a twelve hour period, and the third to indicate minutes during each hour.

In FIG. 21 three endless belts are employed, one to indicate days of the week, another to indicate hours of the day over a 12 hour period and the third to indicate minutes during each hour. The belt adjacent opening 103 is driven at a speed such that the indicating dot 104 moves from one end to the other of opening 103 in seven days. The belt adjacent opening 105 is driven at a speed such that indicating dot 106 moves from one end to the other of opening 105 in twelve hours. The belt adjacent opening 107 is driven at a speed such that the indicating dot 108 moves from one end to the other of opening 107 in 60 minutes.

Figure 22:
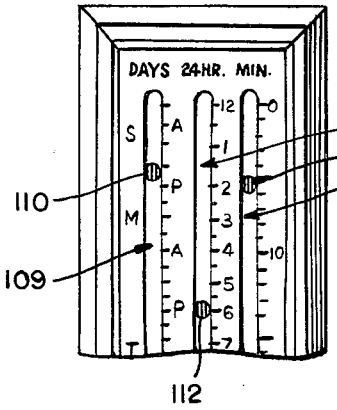
FIG. 22 illustrates another way of utilizing the invention in which three endless belts are employed, one to indicate days of the week, another to indicate hours of the day over a 24 hour period and the third to indicate minutes during each hour.

In FIG. 22 where three endless belts are used, the belt adjacent opening 109 is driven at a speed such that indicating dot 110 moves from one end to the other of opening 109 in seven days. The belt adjacent opening 111 is driven at a speed such that indicating dot 112 moves from one end to the other of opening 111 in 24 hours. The belt adjacent opening 113 is driven at a speed such that the indicating dot 114 moves from one end to the other of opening 113 in sixty minutes.

In FIG. 23 where four endless belts are used, the belt adjacent opening 115 is driven at a speed such that indicating dot 116 moves from one end to the other of said opening in a period of seven days. The belt adjacent opening 117 is driven at a speed such that the indicating dot 118 moves from one end to the other of said opening during a period of 12 hours. The belt adjacent opening 119 is driven at a speed such that indicating dot 120 moves from one end to the other of said opening in a period of 60 minutes. The belt adjacent opening 121 is driven at a speed such that indicating dot 122 moves from one end to the other of said opening in a period of 60 seconds.

In FIG. 24 where four endless belts are used, the belt adjacent openings 123 is driven at a speed such that indicating dot 124 moves from one end to the other of said opening in a period of seven days. The belt adjacent opening 125 is driven at a speed such that indicating dot 126 moves from one end to the other of said opening in a period of 24 hours. The belt adjacent opening 127 is driven at a speed such that indicating dot 128 moves from one end to the other of said oepning in a period of 60 minutes. The belt adjacent opening 129 is driven at a speed such that indicating dot 130 moves from one end to the other in a period of 60 seconds. Thus, the ratio of the speeds of the seconds and minute belts is 60:1, the minute and hour belts 12:1 and 7:1 between the 24 hour belt and the "week" belt.

Some variations and modifications can be made without departing from the invention. As previously indicated, for example, the various means for driving the belts can be mounted from the back or base plate 9 rather than from the belt supporting plate 26. Also it is not essential that in the clock face noon and midnight time indications be at the ends of the elongated openings. They can, for example, be positioned at the central portions of such openings. While the driving mechanism has been illustrated in the drawings as being an electrical synchronous motor, other types of driving mechanisms, including battery driven motors, spring wound or mechanical mechanisms, can be employed. Where two or more belts are employed, each belt can, if desired, be driven by a separate motor or other type of driving mechanism. Usually, however, the desired result is obtained by using a single driving mechanism operating through a gear train synchronized to cause the various belts to move at predetermined speeds with respect to one another.

In order to adjust and synchronize one or more belts it is necessary to drive the belts through a slip clutch or in some other manner so that each belt can be moved independently to a new setting without disturbing the setting of another belt. The only exception is the "seconds" belt. This can be accomplished by using a bent or arcuate washer which is fixed to the driving shaft for each belt and impinges against the adjustment wheel or the sprocket drum so as to drive the latter frictionally while permitting manual movement of sprocket drum through the adjustment wheel without rotating the driving shaft.

The time scales can be calibrated in any desired time units, for example, in 2400 hours as commonly used in military and naval operations. The 24 hour scale lends itself to this type of calibration.

The clock faces can be arranged to read in a horizontal as well as a vertical attitude. The belts can also move up and down as well as the reverse direction or from right to left or left to right in a horizontal attitude. The positions of belts can also be altered, e.g., the seconds belt to the left, minutes in the middle and hours on the right.

It should also be understood that the "elongated opening" in the clock face need not be a slot but can be made of clear glass or plastic and the opaque portions applied by painting or silk screen printing so as to leave a clear, visible elongated area through which the time indicating means on the belt is visible.

The invention is hereby claimed as follows:

1. A time indicating device comprising an endless indicating belt which carries non-digital indicating means thereon that define three or more equally spaced segments of said belt, means comprising a face plate with an elongated opening therein mounted adjacent said belt with said opening in superposed relationship to said non-digital indicating means so that from time to time said indicating means carried by said belt beneath said opening are visible through said opening as said belt is moved past said opening, said face plate carrying time period indicia on the top thereof adjacent said opening, the length of said opening substantially corresponding to the length of one of said segments and said non-digital indicating means being spaced apart a distance corresponding to the length of said opening so that when said belt is moved past said opening there will be a moment when one of said segments will appear over the entire length of said opening with two consecutive said non-digital indicating means appearing, one at each end of said opening, and means for moving said belt containing said non-digital indicating means past said opening.

2. A device as claimed in claim 1 in which said belt contains only three said non-digital indicating means.

3. A device as claimed in claim 1 in which said non-digital indicating means consist of three dots equally spaced around said belt.

4. A device as claimed in claim 1 comprising a plurality of said endless indicating belts, a corresponding number of elongated openings in said face plate through which the respective non-digital indicating means are visible and means for driving the respective belts at predetermined speeds with respect to one another.

5. A device as claimed in claim 4 in which there are three endless indicating belts disposed adjacent three elongated openings, said openings containing time period indicia adjacent thereto on said face plate calibrated in seconds, minutes and hours, respectively, and said driving means being operative to move one of said segments of each said belt from one end to the other of its respective opening at the following speeds: the seconds belt in 60 seconds, the minutes belt in 60 minutes and the hours belt in 12 hours.

6. A device as claimed in claim 1 in which said belt is driven by means operative through a slip clutch to permit moving said belt by manual means to a predetermined setting without affecting the driving mechanism.

* * * * *